United States Patent [19]

Moon

[11] 3,982,519

[45] Sept. 28, 1976

[54] ELECTRONIC-FUEL-INJECTION-SYSTEM ENRICHMENT CIRCUIT FOR USE DURING ENGINE CRANKING

[75] Inventor: Roger A. Moon, Ypsilanti, Mich.

[73] Assignee: Ford Motor Company, Dearborn, Mich.

[22] Filed: May 27, 1975

[21] Appl. No.: 581,079

[52] U.S. Cl. ..... 123/179 L; 123/179 B; 123/179 G

[51] Int. Cl.[2] ..... F02N 17/00

[58] Field of Search ..... 123/179 B, 179 G, 179 L

[56] References Cited

UNITED STATES PATENTS

| | | | |
|---|---|---|---|
| 3,616,784 | 11/1971 | Barr | 123/179 L |
| 3,683,871 | 8/1972 | Barr et al. | 123/179 G |
| 3,792,693 | 2/1974 | Luchaco | 123/179 L |
| 3,797,465 | 3/1974 | Hobo et al. | 123/179 G |

*Primary Examiner*—Wendell E. Burns
*Assistant Examiner*—David D. Reynolds
*Attorney, Agent, or Firm*—Robert W. Brown; Keith L. Zerschling

[57] ABSTRACT

An electronic-fuel-injection-system enrichment circuit for use during cranking of an internal combustion engine having a fuel supply controlled by the fuel injection system. The fuel injection system produces a fuel control electrical signal representative of a quantity of fuel to be injected into the engine. An enrichment circuit, for use during cranking of the engine to increase the quantity of fuel represented by a fuel control electrical signal, is provided. This enrichment circuit includes circuit means for generating an enrichment electrical signal having a characteristic which varies with time subsequent to initiation of cranking of the engine and circuit means for combining the enrichment electrical signal with at least one other electrical signal representative of a fuel quantity to be injected into the engine. The combined electrical signals produce the fuel control electrical signal. The variability with time of the enrichment electrical signal during cranking of the engine tends to increase the quantity of fuel represented by the fuel control electrical signal. The enrichment electrical signal may vary in discrete steps as a function of time. Subsequent to the start of the engine, the enrichment signal may vary with time in a manner tending to decrease the quantity of fuel represented by the fuel control electrical signal.

6 Claims, 3 Drawing Figures

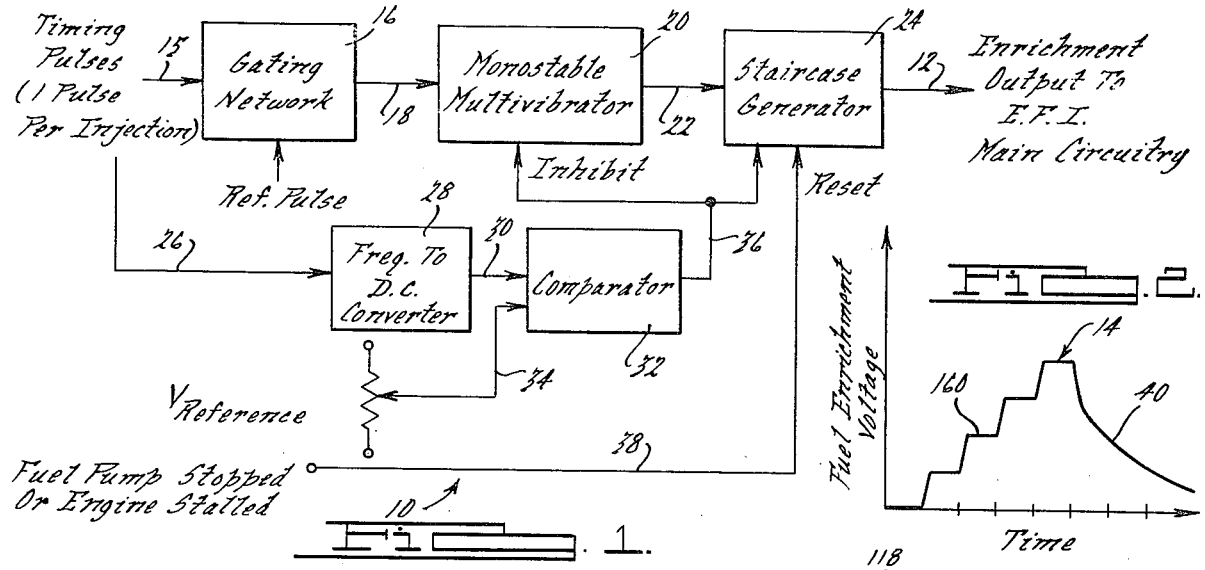
FIG. 1.
FIG. 2.
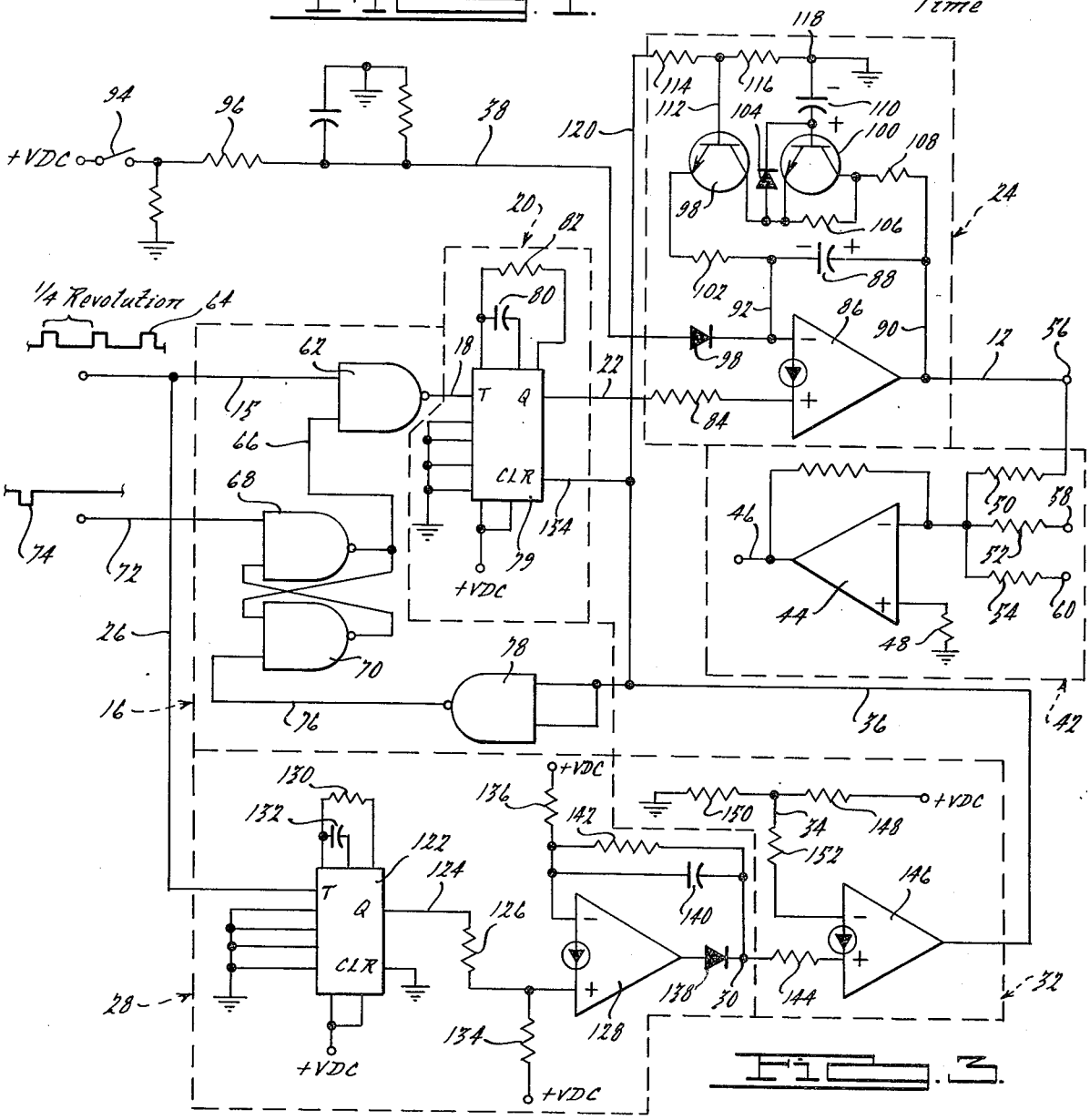
FIG. 3.

ELECTRONIC-FUEL-INJECTION-SYSTEM ENRICHMENT CIRCUIT FOR USE DURING ENGINE CRANKING

BACKGROUND

This invention relates to an enrichment circuit for use in an electronic fuel injection system for controlling the injection of fuel into an internal combustion engine. More particularly, it relates to an enrichment circuit for this purpose which is utilized during cranking of the engine, and preferably for a relatively short time interval after starting of the engine, to increase the quality of fuel supplied to the engine beyond the quantity which would be supplied to the engine were it not being cranked or just started.

The enrichment circuit of the invention is particularly intended for use in an electronic fuel injection system of the type which utilizes an electromagnetic fuel injector or injectors operated intermittently so that the quantity of fuel supplied to the internal combustion engine is a function of the duration of electrical pulses applied to the injectors. Nevertheless, the enrichment circuit of the invention may be utilized with continuous or other types of electronic fuel injection systems which provide an electrical signal having a characteristic which is representative of the amount of fuel to be supplied to an engine. Prior art fuel injection systems which produce a fuel control electrical signal of this kind include those described in U.S. Pat. Nos. 3,741,171 to Dautel, 3,742,920 to Black, 3,747,575 to Eisele et al, 3,747,576 to Gordon et al, 3,747,577 to Mauch et al and 3,763,833 to Rachel. These patents are illustrative of electronic fuel injection systems in which the enrichment circuit teachings of the invention may be incorporated.

In prior art intermittent electronic fuel injection systems for internal combustion engines, the usual technique for controlling fuel injector pulse duration during cranking of the engine is to supply a fixed pulse width to the injectors. This fixed pulse width during cranking may vary as a function of engine temperature or other engine parameters, for example, the fixed pulse width may be of one value when the engine is warm and of a different value when the engine is cold. In any event, this fixed cranking pulse width of the prior art must be determined for each engine design through mapping of the characteristics of that engine so that a suitable pulse width function may be obtained to achieve engine starting. Usually, the fixed pulse width value utilized during cranking is somewhat lean with respect to the air-fuel ratio required to achieve starting of the engine, but the cranking of the engine over a period of time tends to increase the richness of the air-fuel mixture until the engine actually starts. This kind of prior art cranking system does not take into account the condition of the engine with regard to the quantity of fuel which may already be in its intake manifold or combustion chambers immediately prior to cranking.

SUMMARY OF THE INVENTION

It is a main object of the present invention to provide an enrichment circuit in an electronic fuel injection system for use during cranking of an associated internal combustion engine. The enrichment circuit preferably supplies the engine, at the initiation of cranking, with a fuel quantity known to be less than that required to start the engine whether warm or cold, etc., unless the engine already is in a flooded or other unusual condition.

The enrichment circuit of the invention is utilized in an electronic fuel injection system which includes circuit means for generating a fuel control electrical signal representative of a quantity of fuel to be injected into an associated internal combustion engine. The enrichment circuit is intended for use during cranking of the engine to increase the quantity of fuel represented by the fuel control electrical signal and comprises circuit means for generating an enrichment electrical signal having a characteristic which varies with time subsequent to initiation of cranking of the engine. The enrichment circuit also includes circit means for combining the enrichment electrical signal with at least one other electrical signal representative of a fuel quantity to be injected into the engine, the combined electrical signals producing the aforementioned fuel control electrical signal. The variability with time of the enrichment electrical signal during cranking of the engine tends to increase, as a function of time subsequent to initiation of the cranking of the engine, the quality of fuel represented by the fuel control electrical signal. Preferably, the characteristic of the enrichment electrical signal varies by discrete amounts as a function of time subsequent to initiation of cranking of the engine, thereby, tending to produce similar stepped increases in the quality of fuel represented by the fuel control electrical signal. Also, the enrichment circuit preferably includes circuit means for causing the enrichment electrical signal to vary in an opposite direction, relative to its variation during cranking, subsequent to the engine having started, thereby, to produce a gradual tendency toward reduction of the fuel quantity represented by the fuel control electrical signal.

The invention may be better understood by reference to the detailed description which follows and to the drawings.

BRIEF DESCRIPTION OF THE DRAWINGS

FIG. 1 is a schematic block diagram of an enrichment circuit for incorporation in an electronic fuel injection system for a spark ignition internal combustion engine;

FIG. 2 is a graph of voltage versus time for an enrichment electrical signal for use during cranking of a fuel-injected engine and for a short time interval immediately after engine start; and FIG. 3 is a detailed schematic electrical diagram of an enrichment circuit corresponding to the block diagram of FIG. 1 and capable of producing an enrichment electrical signal of the type depicted in FIG. 2.

DETAILED DESCRIPTION

With reference now to the drawings, wherein like numerals refer to like elements in the several views, there is shown a block diagram in FIG. 1 of an enrichment circuit for incorporation in an electronic fuel injection system particularly intended for use with an eight-cylinder, four-cycle, electronically-fuel-injected, spark-ignition internal combustion engine. FIG. 3 illustrates a detailed schematic electrical diagram of circuitry capable of performing the functions illustrated in block form in FIG. 1 and further includes circuit means for combining an enrichment electrical signal produced by the circuitry of FIG. 1 with another electrical signal typcically generated in an electronic fuel injection system and representative of a quantity of fuel to be injected into the engine.

With particular reference now to FIG. 1, there is shown an enrichment circuit, generally designated by the numeral 10, the function of which is to produce an output enrichment electrical signal at 12 having the waveform 14 shown in FIG. 2, which is a voltage that varies as a function of time subsequent to initiation of cranking of the engine.

In the block diagram of FIG. 1, timing pulses proportional to engine speed are supplied as the input to a gating network 16 which has an output 18. The output 18 forms the input to a monostable multivibrator 20 having an output 22. The output 22 of the multivibrator 20 is supplied to a staircase generator 24 which produces the voltage 14 of FIG. 2 on its output 12.

Preferably, the timing pulses supplied to the gating network 16, and also as the input 26 to a frequency to DC voltage converter 28, occur at the rate of one pulse per injection from the electrically actuated fuel injectors of the fuel injection system. If there are eight fuel injectors sequentially and independently controlled by the electronic fuel injection system, then there would be eight timing pulses for every two revolutions of the engine crankshaft, or, one pulse for each one-quarter revolution of the crankshaft. Various means may be utilized to provide these timing pulses, such as an electromagnetic pickup positioned adjacent a toothed or slotted disc or the like attached to the engine crankshaft or to the engine's ignition system distributor. Such devices are well known in the electronic fuel injection art and in the field of electronic ignition systems for spark ignition engines. Timing pulse generating devices, for example, are illustrated in U.S. Pat. No. 3,835,819 to Anderson, Jr.

The output of the frequency-to-voltage converter 28 is one input 30 to a voltage comparator 32. The other input 34 to the comparator is a reference voltage. The output 36 of the comparator is supplied to the monostable multivibrator 20 to inhibit its output under circumstances to be described hereinafter. Also, a signal lead 38 is supplied to the staircase generator 24 to reset the staircase generator in the event the fuel pump, normally forming a part of an electronic fuel injection system, stops or the engine stalls.

In the operation of the FIG. 1 circuitry, timing pulses are supplied on the input 15 to the gating network 16 when cranking of the engine is initiated. These timing pulses are transferred through the gating network to its output 28 so that each timing pulse triggers the monostable multivibrator 20. As a result, one pulse of fixed duration appears on the multivibrator output 22 for each of the timing pulses applied to the input 15. The staircase generator 24 integrates the voltage level of these multivibrator output pulses on its input 22 over the duration of each of the fixed duration multivibrator output pulses. This produces the discrete step changes in voltage level of the signal 14 appearing on output 12 of the staircase generator. The rise time of each of the discrete step changes correponds to the width of the output pulses from the multivibrator 20.

The timing pulses applied on input 26 to the frequency-to-voltage converter 28 result in a voltage on the convertor output 30 which is proportional to the angular velocity of the engine output shaft. During cranking of the engine, this voltage on output 30 is substantially constant, but when the engine starts, the voltage at output 30 increases substantially. The reference voltage on lead 34 is set to correspond to an engine angular velocity indicative of a running engine. When the engine starts, the voltage on output 30 exceeds the reference voltage on comparator input 34, and the comparator output 36 provides a signal indicative of this condition. The signal on output 36 inhibits the multivibrator 20 from the generation of any further pulses on its output 22 and the discrete steps in the signal 14 on the output 12 of the staircase generator 24 cease to occur. Also, the signal at the output 36 of the comparator 32 is applied to the staircase generator 24 to cause its output voltage signal 14 to decrease in the substantially exponential manner shown at 40 in FIG. 2. Preferably, the initial decay of the voltage 14 subsequent to engine starting is quite rapid and then decreases more gradually.

With particular reference now to the detailed circuit diagram of FIG. 3 illustrating the circuitry shown in block form in FIG. 1, there is shown in addition to the circuitry 10 a circuit portion 42, which may be part of a conventional electronic fuel injection systems. The circuit portion 42 is utilized to combine the enrichment electrical signal for use during engine cranking, appearing on output lead 12, with one or more other electrical signals representative of the quantity of fuel to be injected into the engine. As shown, the signal-combining circuit means 42 comprises a summing operational amplifier 44 having an output lead 46 on which a fuel control electrical signal appears. This signal on output lead 46 has a voltage level which is representative of a quantity of fuel to be injected into the engine. This voltage signal may be converted, by circuit means not shown, to a fuel injection pulse width in a manner well known in the prior art.

The positive input to the summing amplifier 44 is connected through an input resistor 48 to ground, and the electrical signals to be combined by summing are applied to the negative input of the amplifier 44 through parallel-connected input resistors 50, 52 and 54. The enrichment electrical signal on output lead 12 is applied to input terminal 56 of the input resistor 50, and this enrichment signal is combined with at least one other electrical signal representative of the quantity of fuel to be injected into the engine. The other electrical signal or signals are applied during cranking of the engine to the input terminal 58 of input resistor 52 or to input terminal 60 of input resistor 54 or to both terminals. Furthermore, additional input signals may be summed with these if desired. The signal or signals, combined with the enrichment electrical signal at input terminal 56, may represent a basic fuel quantity required by the engine during cranking and may be a function of engine load during cranking, or the amount of air entering the engine during cranking or its temperature, etc. In any event, the enrichment electrical signal at input terminal 56 is combined or added to the other electrical signal or signals to produce the fuel control output electrical signal on amplifier output lead 46.

The gating network 16 of the enrichment circuit 10 includes a NAND-gate 62 having one input connected to the lead 15 on which the timing pulses, spaced one-quarter of a crankshaft revolution apart, appear as indicated by waveform 64. The other input to the NAND-gate 62 is the output 66 of a flip-flop formed by crossed NAND-gates 68 and 70.

NAND-gate 68 has an input 72 to which is applied a negative going reference pulse 74 that occurs once for every two revolutions of the engine crankshaft. The pulse 74 may be generated by any suitable means, such as a switch located in the engine's distributor and closed by a cam once per revolution of the engine's camshaft. Preferably, the reference pulse 74 occurs just before fuel is to be injected for the number one combustion chamber of the engine. The NAND-gate 70 has an input 76 which is the output of a NAND-gate invertor 78 that has as its input the signal appearing on the output lead 36 of the comparator 32.

The output lead 18 of the NAND-gate 62 forms the trigger input to the monostable multivibrator circuit 20. The multivibrator circuit 20 preferably is formed from an integrated circuit type CD4047 multivibrator or the equivalent having a +VDC voltage supply and timing elements including a capacitor 80 and resistor 82. The Q output of the multivibrator 79 forms the output 22 of the multivibrator circuit 20 and is applied through an input resistor 84 to the positive input of a Norton amplifier 86, which preferably is a National Semiconductor Corporation type LM3900 or the equivalent, in the staircase generator circuit 24.

The enrichment electrical signal for use during engine cranking and immediately thereafter appears on the output lead 12 of the amplifier 86. An integrating capacitor 88 has one of its terminals connected by a lead 90 to the output lead 12 of the amplifier 86, and has its other terminal connected by a lead 92 to the negative input of the amplifier 86. A positive DC voltage is applied through a normally open switch 94, a resistor 96 and a blocking diode 98, to the negative input of the amplifier 86. Circuit means equivalent to the switch 94 conventionally is included in electronic fuel injection systems to provide a positive voltage signal in the event the fuel pump for the fuel supply system stops or the engine stalls. Otherwise, the switch means 94 remains open. Thus, the negative input to the amplifier 86 normally is at or near ground potential.

The staircase generator circuit 24 also includes NPN transistors 98 and 100. The emitter of the transistor 98 is connected through a resistor 102 to the junction formed between the capacitor 88 and the negative input of amplifier 86. The collector of the transistor 98 is connected to the junction formed between the anode of a blocking diode 104, the emitter of the transistor 100, and a resistor 106 connected between the emitter and collector of the transistor 100. The collector of the transistor 100 is connected through a current limiting resistor 108 and by the lead 90 to the output lead 12 of amplifier 86. A capacitor 110 is connected between the base of the transistor 100 and ground potential, and the base of the transistor 98 is connected by a lead 112 to the junction formed between resistors 114 and 116. Resistors 114 and 116 form a divider for the voltage between ground potential at 118 and the potential on a lead 120 connected to the output lead 36 of the comparator 32. The divided voltage is supplied by the lead 112 to the base of the transistor 98.

The frequency-to-DC voltage converter 28 includes a monostable multivibrator 122, which also may be an integrated circuit type CD4047, having its trigger input supplied via a lead 26 with the timing pulses 64 and having its Q output appearing on lead 124 applied through an input resistor 126 to the positive input of a preferably type LM3900 Norton amplifier 128. The multivibrator 122 has a positive DC supply voltage, has its clear input (CLR) connected to ground and has timing components for its output pulse including a resistor 130 and a capacitor 132.

The positive input of the amplifier 128 is connected through a resistor 134 to a +DC voltage supply. The negative input of the amplifier 128 also is connected through a resistor 136 to a +DC voltage supply. The output lead of the amplifier 128 is connected to the anode of a stabilizing diode 138 whose cathode is connected to the junction 30, which is the output junction of the frequency-to-voltage converter 28. A capacitor 140 and a resistor 142 are connected in parallel between the output junction 30 and the negative input of the amplifier 128.

The output junction 30 of the frequency-to-voltage converter 28 is connected through an input resistor 144 to the positive input of a preferably type LM3900 Norton amplifier 146 in the comparator circuit 32. A voltage divider is formed by series-connected resistors 148 and 150 connected between a +DC voltage supply and ground. A lead 34 connected to the junction formed between the resistors 148 and 150 supplies a reference current, through an input resistor 152, to the negative input of the amplifier 146. The output lead 36 of the amplifier 146 is the output of the comparator circuit 32.

In the operation of the circuitry of FIG. 3, the monostable multivibrator 79 is triggered by the positive-going edges of pulses applied to its input 18 as long as the signal applied to its clear (CLR) input lead 154 is maintained at a low voltage level. However, the timing pulses 64 on input lead 15 of NAND-gate 62 are not transmitted to the monostable multivibrator input lead 18 unless the NAND-gate 62 input 66 is maintained at a high voltage level. For reasons to be described hereinafter, the flip-flop formed by NAND-gates 68 and 70 is reset when power first is applied to the electronic ignition system so that the output of NAND-gate 70 is a high voltage level and the output of NAND-gate 68 is a low voltage level until the reference pulse 74 occurs. When the negative-going pulse 74 occurs, the flip-flop is actuated and the output of NAND-gate 68 goes to a high voltage level. This permits the timing pulses 64 to be transferred to the multivibrator input lead 18.

Each positive-going edge of the timing pulses triggers the multivibrator 79 so that its Q output on lead 22 goes to a high voltage level and is maintained at such level for a fixed time period determined by the values of the capacitor 80 and resistor 82. This fixed pulse width is substantially less than the time required for one-quarter revolution of the engine crankshaft at engine cranking angular velocity.

The fixed duration pulses on output lead 22 of multivibrator 79 are applied to the integrating amplifier 86 through input resistor 84. As a result of this integration, the voltage on the amplifier output lead 12 increases during each of the output pulses produced by multivibrator 79. In other words, the amplifier 86 integrates over the width of these pulses. During this integration, the output lead 36 of the comparator circuit 32 is at a low voltage level and the transistors 98 and 100 in the staircase generator 24 are nonconductive. The capacitors 88 and 110 in the staircase generator circuit are charged with the polarities indicated in FIG. 3. Between timing pulses 64, the voltage level on lead 12 is maintained constant at the voltage level achieved upon integration of the previous monostable multivibrator 79 output pulse. With each increase in voltage on output lead 12, the capacitors 88 and 110 charge to a higher voltage level. The step-like first portion 160 of the voltage waveform 14 is the result of the successive integration by the amplifier 86 of four of the timing pulses 64. During each rise in the voltage on output lead 12, the capacitor 110 is charged through the circuit including lead 90, resistor 108, resistor 106, diode 104 and the ground circuit at junction 118. Diodes 104 and 98 prevent discharge, respectively, of capacitors 110 and 88 between timing pulses 64.

As the enrichment electrical signal voltage 14 on lead 12 increases in step-like fashion, this voltage is combined, with at least one other electrical signal representative of a fuel quantity to be injected into the engine, by the combining circuit means 42 to produce on output lead 46 of amplifier 44 a fuel control electrical signal having a voltage level which may be used directly or indirectly to control the amount of fuel injected into the engine during cranking.

During cranking of the engine and at least until the engine is running and the starting system de-energized, the timing pulses 64 are applied via lead 26 to the trigger input of monostable multivibrator 122 in the frequency-to-voltage convertor 28. The multivibrator 122 provides corresponding output pulses on its Q output lead 124 that are of fixed width and amplitude. These fixed width and amplitude pulses are applied to the amplifier 128 and its associated circuitry to produce a voltage at junction 30 which has a magnitude proportional to the frequency of the mulitvibrator 122 output pulses.

During cranking of the engine, its output shaft may rotate at, for example, between 50 to 150 rpm. When the engine fires or starts, the output shaft rpm swiftly rises and the frequency of the multivibrator 122 output pulses also swiftly increases. This raises the voltage at the junction 30. When the junction 30 voltage is sufficiently high so that the current flowing into the positive input of the amplifier 146 exceeds the reference current flowing into its negative input, then the output lead 136 of amplifier 146 reaches a high voltage level. This may occur when the engine crankshaft is rotating at, for example, 300 rpm.

The high voltage level on output lead 36 is applied to the clear input lead 154 of multivibrator 79 preventing it from producing any further pulses on its output lead 22. This prevents further increase in the magnitude of the enrichment electrical signal 14 appearing on output 12 of amplifier 86. Also, the high voltage level on comparator output lead 36 is applied via lead 120 to the voltage divider formed by resistors 114 and 116.

With the voltage applied across this voltage divider, the lead 112 supplies a positive voltage to the base of transistor 98 rendering it conductive. Since the collector-emitter output circuit of transistor 98 is connected in series with the collector-emitter output circuit of the transistor 100, the transistor 100 also is rendered conductive due to the charge across the capacitor 110.

With the transistors 98 and 100 conductive, capacitor 88 discharges through the circuit including resistor 108, the collector-emitter output circuit of the transistor 100 and parallel resistor 106, the collector-emitter output circuit of transistor 98 and resistor 102. Also, capacitor 110 discharges through the ground circuit, the base-emitter circuit of the transistor 100, the collector-emitter output circuit of transistor 98 and resistor 102. After capacitor 110 has discharged, the transistor 100 is rendered nonconductive and capacitor 88 continues to discharge through resistor 108, resistor 106, the collector-emitter output circuit of transistor 98 and resistor 102. Thus, subsequent to initiation of engine starting (the engine having begun to run), the discharge of capacitors 88 and 110 causes the enrichment electrical signal 14 to decrease in magnitude quite rapidly until transistor 100 is rendered nonconductive and then to decrease more slowly in an exponential manner. This is indicated by the portion 40 of the waveform in FIG. 2.

When power is first supplied to the circuitry of FIG. 3, the output signal on lead 36 attains a high voltage level momentarily. Invertor 78 inverts this momentary high voltage level to produce a low voltage level on its output lead 76 forming one input to the NAND-gate 70 to reset the flip-flop formed by this NAND-gate and NAND-gate 68. This resetting of the flip-flop maintains the output of NAND-gate 68 at a low voltage level until the reference pulse 74 occurs, after which lead 66 is maintained, until the engine starts, at the high voltage level previously described.

In the event the engine stalls or its fuel pump is stopped, the switch 94 closes applying positive voltage to the lead 38 and, through blocking diode 98, to the negative input of the amplifier 86. This voltage causes a current to flow through the diode 98 and into the capacitor 88 causing the latter to be discharged. The capacitor 110 also is discharged as a result. Preferably, the capacitance of capacitor 88 is on the order of 50 times as great as that of capacitor 110.

Based upon the foregoing description of the invention, what is claimed is:

1. In an electronic fuel injection system for controlling the injection of fuel into an internal combustion engine having an output shaft, said fuel injection system including circuit means for generating a fuel control electrical signal representative of a quantity of fuel to be injected into said engine, an enrichment circuit for use during cranking of said engine to increase the quantity of fuel represented by said fuel control electrical signal, said enrichment circuit comprising:

staircase generator circuit means for generating an enrichment electrical signal having a voltage the magnitude of which increases, subsequent to initiation of cranking of said engine, by discrete amounts at spaced instants in time the interval between which is determined by the angular velocity of the output shaft of said engine; and circuit means for combining said enrichment electrical signal with at least one other electrical signal representative of a fuel quantity to be injected into said engine, said combined electrical signals producing said fuel control electrical signal, and the variability with time of said enrichment electrical signal during cranking of said engine tending to increase, as a function of time subsequent to initiation of cranking of said engine, the quantity of fuel represented by said fuel control electrical signal.

2. An enrichment circuit according to claim 1 wherein said staircase generator circuit means includes means for causing the magnitude of said voltage of said enrichment electrical signal to decrease as a function of time subsequent to the starting of said engine.

3. An enrichment circuit according to claim 1 which further includes a monostable multivibrator having an output coupled to said staircase generator circuit means, said staircase generator circuit means including circuit means for integrating output pulses produced by said monostable multivibrator, said discrete amounts of increase of the magnitude of said voltage characteristic of said enrichment electrical signal being produced as a result of the integration of the output pulses produced by said monostable multivibrator.

4. An enrichment circuit according to claim 3 wherein said integrating circuit means comprises an amplifier having an input and an output and a feedback capacitor connected between said amplifier input and output.

5. An enrichment circuit according to claim 3 which includes circuit means for generating an engine-started electrical signal at a predetermined angular velocity of the output shaft of said engine, said staircase generator circuit means including means responsive to said engine-started electrical signal to cause the magnitude of said enrichment electrical signal voltage to decrease as a function of time subsequent to the occurrence of said engine-started electrical signal.

6. An enrichment circuit according to Claim 5 wherein said monostable multivibrator is responsive to said engine-started electrical signal to inhibit said monostable multivibrator from producing output pulses.

* * * * *